US009038863B2

(12) United States Patent
Jung

(10) Patent No.: US 9,038,863 B2
(45) Date of Patent: May 26, 2015

(54) NOZZLE STRUCTURE OF DISPENSER PUMP BUTTON

(75) Inventor: Seo-Hui Jung, Incheon (KR)

(73) Assignee: YONWOO CO. LTD., Incheon (KR)

( * ) Notice: Subject to any disclaimer, the term of this patent is extended or adjusted under 35 U.S.C. 154(b) by 24 days.

(21) Appl. No.: 13/983,035

(22) PCT Filed: Feb. 10, 2012

(86) PCT No.: PCT/KR2012/000986

§ 371 (c)(1),
(2), (4) Date: Jul. 31, 2013

(87) PCT Pub. No.: WO2012/108709

PCT Pub. Date: Aug. 16, 2012

(65) Prior Publication Data

US 2013/0306682 A1 Nov. 21, 2013

(30) Foreign Application Priority Data

Feb. 10, 2011 (KR) ..... 10-2011-0011692

(51) Int. Cl.

| | |
|---|---|
| ***B67D 7/58*** | (2010.01) |
| ***B05B 1/30*** | (2006.01) |
| ***B05B 11/00*** | (2006.01) |
| ***B65D 83/14*** | (2006.01) |

(52) U.S. Cl.

CPC ..... *B05B 1/3013* (2013.01); *A45D 2200/056* (2013.01); *B05B 11/0067* (2013.01); *B65D 83/7535* (2013.01)

(58) Field of Classification Search

CPC ..... B05B 1/3013; B05B 11/0067; B05B 11/0072; B05B 11/007; A45D 2200/056; B65D 83/7535

USPC ..... 222/420–422, 488–498, 566–568, 212, 222/321.3, 380, 383.1, 400.5, 402.1, 509, 222/518; 239/337, 533.1, 453, 455, 459, 239/533.13, 533.15, 571, 583

See application file for complete search history.

(56) References Cited

U.S. PATENT DOCUMENTS

| | | | | |
|---|---|---|---|---|
| 1,941,520 A * | 1/1934 | Wiegandt | ..... | 222/493 |
| 2,711,271 A * | 6/1955 | Schlicksupp | ..... | 222/493 |
| 5,154,325 A * | 10/1992 | Ryder et al. | ..... | 222/189.06 |

(Continued)

FOREIGN PATENT DOCUMENTS

| | | | |
|---|---|---|---|
| JP | 2010-215245 | A | 9/2010 |
| KR | 20-0282746 | Y1 | 7/2002 |
| KR | 10-2004-0071153 | A | 8/2004 |
| KR | 20-0396812 | Y1 | 9/2005 |

OTHER PUBLICATIONS

International Search Report for PCT/KR2012/000986 mailed Sep. 28, 2012.

*Primary Examiner* — Frederick C Nicolas
*Assistant Examiner* — Bob Zadeh

(57) ABSTRACT

The present invention relates to a nozzle structure of a dispenser pump button. According to the present invention, the nozzle structure of the dispenser pump button is designed in such a way that an outer nozzle with a discharge hole forwardly moves by the pressure of the content, and the content is discharged through the discharge hole distanced from an inner nozzle, thereby preventing the deformation of the nozzle. Therefore, the inflow of air into a cosmetic container is blocked, and thus the deterioration of the content can be prevented.

6 Claims, 9 Drawing Sheets

(56) References Cited

U.S. PATENT DOCUMENTS

| | | | | |
|---|---|---|---|---|
| 5,558,258 | A * | 9/1996 | Albini et al. | 222/496 |
| 6,543,703 | B2 * | 4/2003 | Blake | 239/106 |
| 7,516,874 | B2 * | 4/2009 | Kneer | 222/497 |
| 7,578,417 | B2 * | 8/2009 | Son | 222/257 |
| 8,245,884 | B2 * | 8/2012 | Byeon | 222/256 |
| 8,328,120 | B2 * | 12/2012 | Vanblaere et al. | 239/533.1 |
| 8,827,124 | B2 * | 9/2014 | Painchaud et al. | 222/547 |

* cited by examiner

NOZZLE STRUCTURE OF DISPENSER PUMP BUTTON

TECHNICAL FIELD

The present invention relates to a nozzle structure of a dispenser pump button, and in particular to a nozzle structure of a dispenser pump button which has features in that an outer nozzle with discharge hole moves in a forward direction by the pressure of contents, and the contents can be discharged through a space distanced from an inner nozzle, thus preventing a deformation of a nozzle, and the spoilage of the contents can be prevented by blocking the inflow of air into the interior of a cosmetic container.

BACKGROUND ART

The dispenser is a device which is generally coupled to the top of a sealed container full of gas, liquid or a certain content and serves to discharge the contents of the interior of the sealed container by a certain amount by the pressing pressure. The above mentioned dispenser is applied to various sealed containers which store cosmetics, perfume or chemicals or foods. At the top of the dispenser is provided a button that a user presses with hands.

At the button for the above mentioned dispenser is provided a nozzle through which to discharge the contents to the outside. From now on, the structure of the nozzle for a conventional dispenser button will be descried with reference to the Korean Utility Model Registration No. 20-0418954.

In the above Korean Utility Model Registration No. 20-0418954, there is provided a cosmetic discharge pump which has features in that the contents can be discharged as the discharge portion of a cut-away nozzle is open by a discharge pressure of contents as a user presses a press button of a discharge pump, which cosmetic discharge pump further comprises a sealed shaft 30 in the interior of the nozzle 22 so as to more stably bock the discharge portion 41.

However, the above mentioned conventional nozzle structure for a dispenser button has features in that the contents are discharged as the discharge portion 41 is widened by the pressure of the contents in a state that the sealed shaft 30 and the rubber tube 40 are fixed, so the discharge portion 41 keeps deforming while it is used, so air may be inputted into the interior of the cosmetic container through the discharge portion 41, which results in the spoilage of the contents.

DISCLOSURE OF INVENTION

Accordingly, the present invention is made to resolve the above mentioned problems. It is an object of the present invention to provided a nozzle structure of a dispenser pump button which has features in that an outer nozzle with discharge hole moves in a forward direction by the pressure of contents, and the contents can be discharged through a space distanced from an inner nozzle, thus preventing a deformation of a nozzle, and the spoilage of the contents can be prevented by blocking the inflow of air into the interior of a cosmetic container.

To achieve the above objects, there is provided a nozzle structure of a dispenser pump button which is engaged to a discharge portion 11 of a dispenser pump button 10 for thereby discharging contents to the outside, comprising an inner nozzle 100 which is formed in a cylindrical shape engaged to the discharge portion 11 and has a plurality of content inflow holes 120 formed at an end portion of a rear surface and spaced apart at regular intervals, and a blocking rod 130 which forwardly protrudes from the center of an end of the rear surface; an outer nozzle 200 which includes a mounting part 210 which is engaged surrounding the blocking rod 130 and moves forwards and backwards and is mounted at an end of the inner side of the inner nozzle 100; and a content movement tube 220 which forwardly extends from the center of the mounting part 210 for thereby forming a passage through which the contents moves, and has a discharge hole 221 which is opened and closed by the blocking rod 130; an elastic member 300 which is engaged surrounding the outer nozzle 200 and moves backwardly the outer nozzle 200; and an elastic member fixing part 400 which is engaged surrounding the inner nozzle 100 at the inner side of the inner nozzle 100 and has an elastic member mounting shoulder 420 at which the elastic member 300 is mounted in the inward direction, for thereby fixing one side of the elastic member 300.

In addition, at the mounting part 21 are provided a plurality of elastic member support parts 211 which are spaced apart at regular intervals for thereby supporting the elastic member 300.

In addition, at an outer surface of the inner nozzle 100 is formed an engaging protrusion 150 fixed at the discharge portion 11, and at an inner surface is formed an engaging groove 140 to which the elastic member fixing part 400 is engaged.

In addition, at the elastic member fixing part 400 is formed an engaging protrusion 410 which corresponds to the engaging groove 140.

In addition, the inner nozzle 100, the outer nozzle 200, the elastic member 300 and the elastic member fixing part 400 are integrated in a module type and are engaged to the engaging groove 12 formed at the discharge portion 11 through the engaging protrusion 150 of the inner nozzle 100.

To achieve the above objects, there is provided a nozzle structure of a dispenser pump button which is engaged to a discharge portion 11 of a dispenser pump button 10 for thereby discharging contents to the outside, comprising an inner nozzle 500 which is formed in a cylindrical shape engaged to the discharge portion 11 and has a plurality of content inflow holes 510 formed at an end portion of a rear surface and spaced apart at regular intervals, and a blocking rod 520 which forwardly protrudes from the center of an end of the rear surface; an outer nozzle 600 which includes a cylindrical mounting part 620 which is engaged surrounding the blocking rod 520 and moves forwards and backwards and is mounted at an end of the inner side of the inner nozzle 500, the front end "x" and the end portion "y" being formed in a piston structure coming into contact with the end of the inner side of the inner nozzle 500; and a content movement tube 620 which forwardly extends from the center of the front surface of the mounting part 610 for thereby forming a passage through which the contents move and has a discharge hole 621 which is opened and closed by the blocking rod 520; an elastic member 700 which surrounds the outer nozzle 600 and is mounted at the mounting part 610 and moves backwards the outer nozzle 600; and an elastic member fixing part 800 which is engaged surrounding the outer nozzle 600 and the elastic member 700 and has an elastic member mounting shoulder 810 at the front surface in the inward direction for thereby mounting the elastic member 810, and an engaging part 820 at the rear surface, which is engaged at the inner side of the inner nozzle 50.

In addition, at the inner surface of the inner nozzle 500 is formed an engaging groove 530 at which the elastic member fixing part 800 is fixed, and at the elastic member fixing part 800 is formed an engaging protrusion 821 which is engaged to the engaging groove 530.

In addition, at the end of the blocking rod 520 is formed a protrusion 521 which protruded towards the outside of the outer nozzle 600.

ADVANTAGEOUS EFFECTS

According to the present invention, an outer nozzle with discharge hole moves in a forward direction by the pressure of contents, and the contents can be discharged through a space distanced from an inner nozzle, thus preventing a deformation of a nozzle, and the spoilage of the contents can be prevented by blocking the inflow of air into the interior of a cosmetic container.

The nozzle is made in a module type by which the nozzle can be easily detachable from the button, which helps design various buttons, and only the nozzle can be separately assembled and inspected during the manufacture process for thereby achieving a lowered defective ratio, which leads to the increased productivity.

BEST MODES FOR CARRYING OUT THE INVENTION

Figure 1:
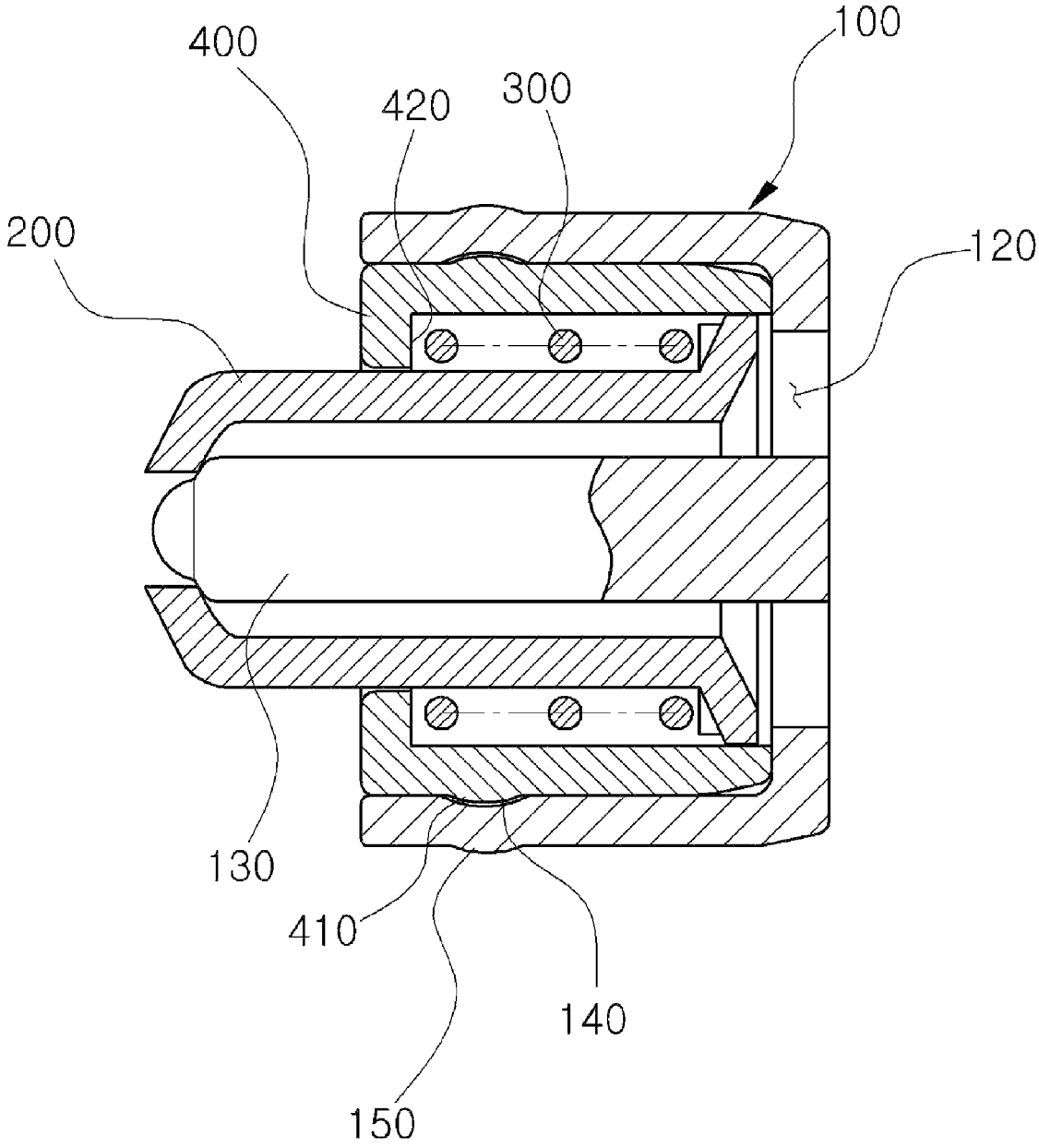
FIG. 1 is a cross sectional view illustrating a construction of a nozzle of a dispenser pump button according to a preferred embodiment of the present invention.

The present invention will be described with reference to the accompanying drawings, and the same reference numerals appearing in the drawings represent same elements.

Figure 2:
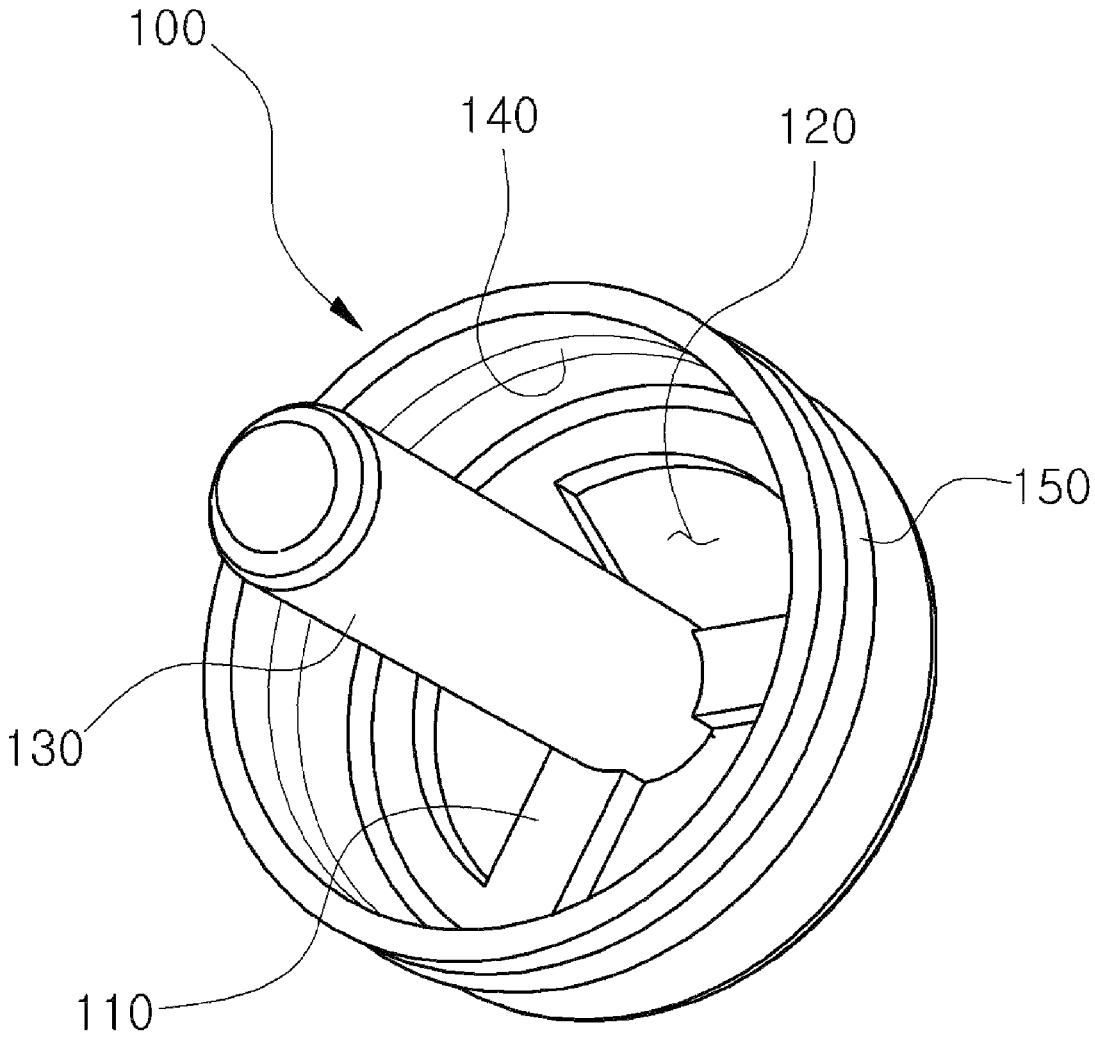
FIG. 2 is a perspective view illustrating a construction of an inner nozzle of a nozzle structure of a dispenser pump button according to a preferred embodiment of the present invention.
Figure 3:
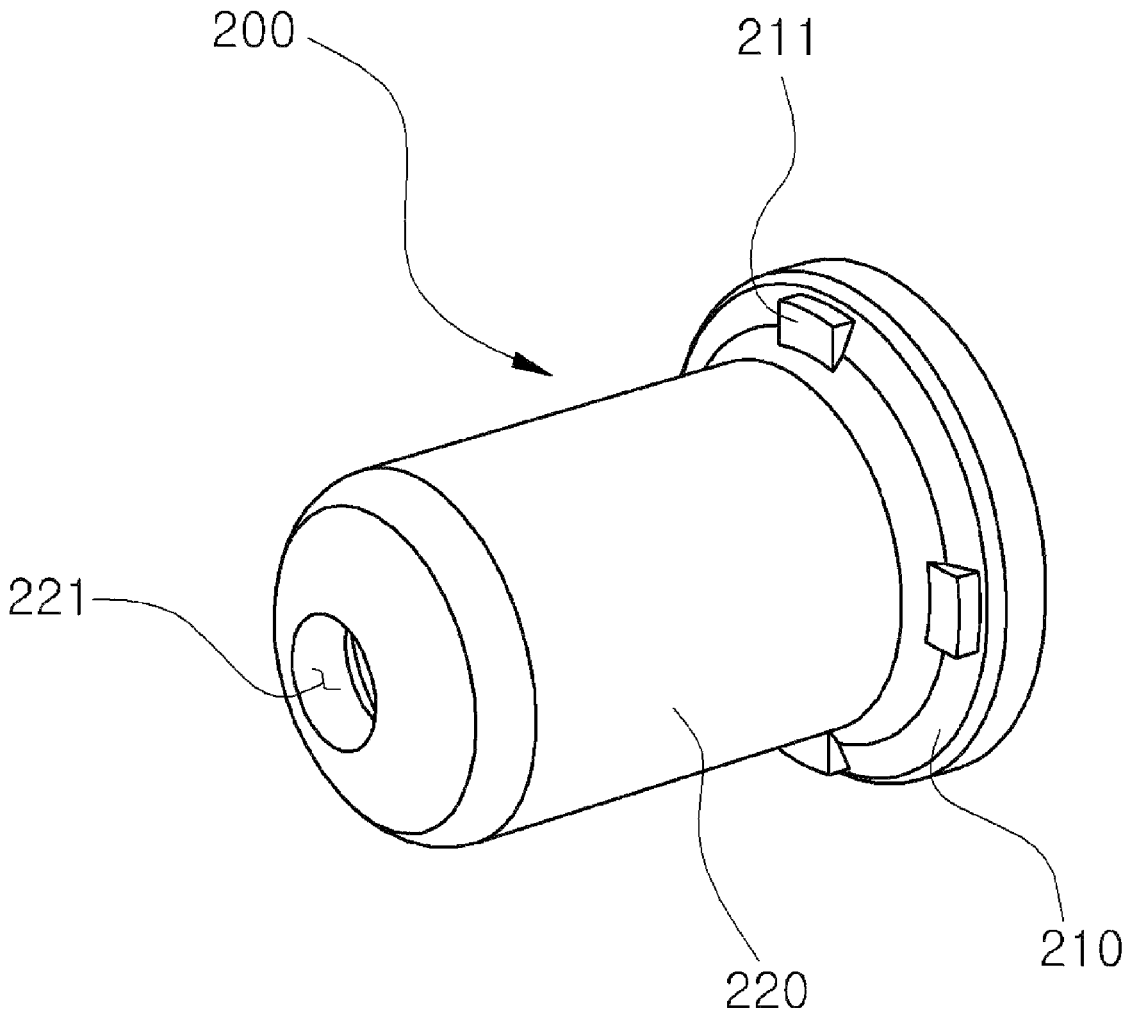
FIG. 3 is a perspective view illustrating a construction of an outer nozzle a nozzle structure of a dispenser pump button according to a preferred embodiment of the present invention.

FIG. 1 is a cross sectional view illustrating a construction of a nozzle of a dispenser pump button according to a preferred embodiment of the present invention. FIG. 2 is a perspective view illustrating a construction of an inner nozzle of a nozzle structure of a dispenser pump button according to a preferred embodiment of the present invention. FIG. 3 is a perspective view illustrating a construction of an outer nozzle a nozzle structure of a dispenser pump button according to a preferred embodiment of the present invention.

Figure 4:
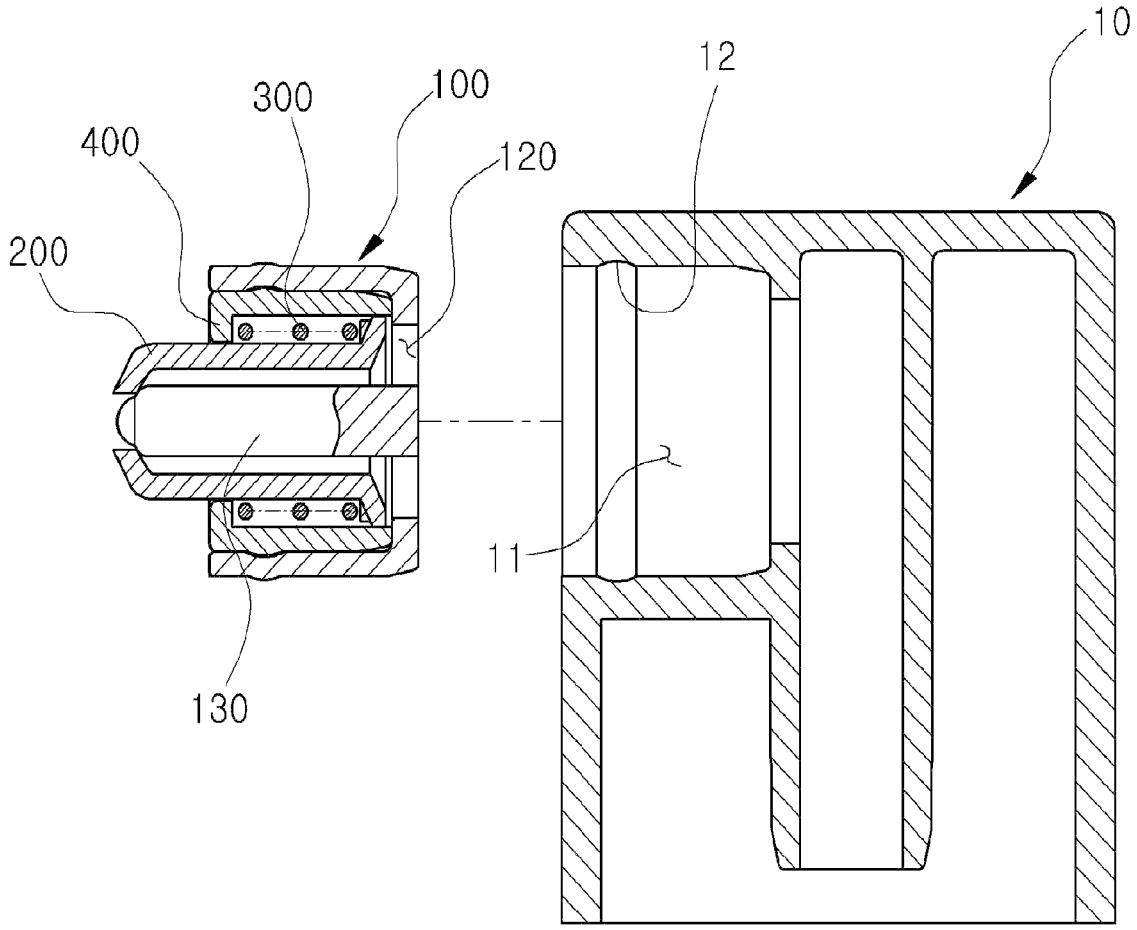
FIG. 4 is a disassembled cross sectional view illustrating a state that a nozzle of a dispenser pump button is coupled to a button according to a preferred embodiment of the present invention.
Figure 5:
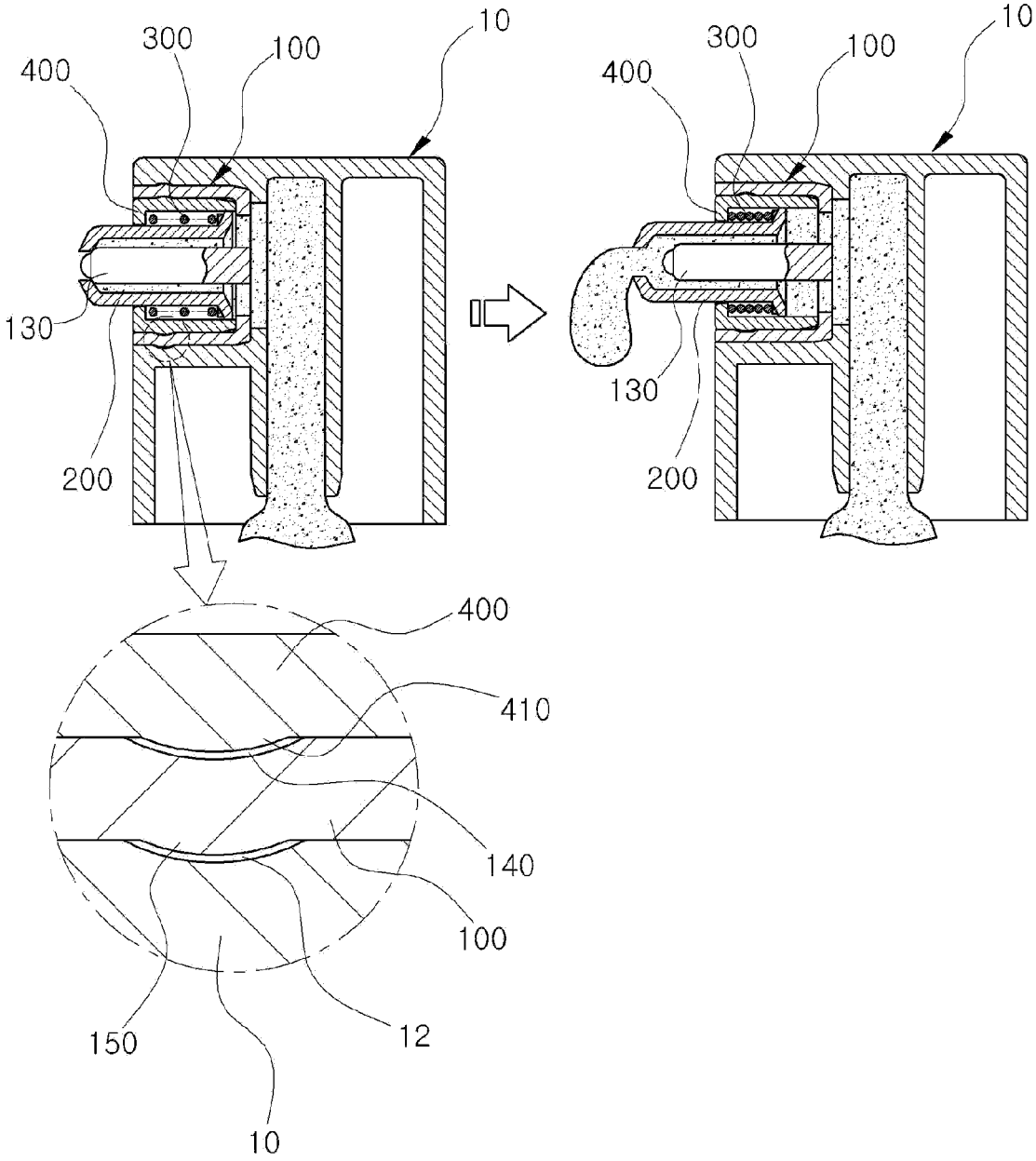
FIG. 5 is a view illustrating an operation procedure of a nozzle of a dispenser pump button according to a preferred embodiment of the present invention.

FIG. 4 is a disassembled cross sectional view illustrating a state that a nozzle of a dispenser pump button is coupled to a button according to a preferred embodiment of the present invention. FIG. 5 is a view illustrating an operation procedure of a nozzle of a dispenser pump button according to a preferred embodiment of the present invention.

As shown in FIGS. 1 to 5, the nozzle structure of the dispenser pump button according to a preferred embodiment of the present invention comprises an inner nozzle 100, an outer nozzle 200, an elastic member 300, and an elastic member fixing part 400.

The inner nozzle 100 is formed in a cylindrical shape which is coupled to a discharge portion 11 of the dispenser pump button 10. From the inner surface of its rear end to the center are provided a plurality of extensions 110 at regular intervals while forming a content inflow hole 120 in order for the contents discharged through the discharge portion 11 to flow inside.

At the inner nozzle 100 is provided a blocking rod 130 which protrudes in a forward direction from the center portion coming into contact with the plurality of the extensions 110, so the discharge hole 221 can be opened and closed as the outer nozzle 200 moves forwards or backwards.

In the present invention, at an outer surface of the inner nozzle 100 is provided an engaging protrusion 150 for the sake of an engagement to the discharge portion 11. The discharge portion 11 can be easily assembled with the aid of the engaging protrusion 150. At this time, at the inner surface of the discharge portion is preferably provided an engaging groove 12 for the sake of an engagement to the engaging protrusion 150.

At an inner surface of the inner nozzle is provided an engaging groove 140 to which an elastic member fixing part 400, which will be described later, is coupled.

Here, the outer nozzle 200 comprises a mounting part 210 which surrounds the blocking rod 130 and is secured in the interior of the inner nozzle 100 and moves forwards or backwards by the pressure of the contents "a" or the elastic force of the elastic member 300 and is mounted at the inner end of the inner nozzle 100, and a content movement tube 220 which extends from the center of the mounting part 210 and forms a passage through which the contents "a" move.

The mounting part 210 mounts at the inner end of the inner nozzle 100 when the outer nozzle 200 moves backwards by the elastic force of the elastic member 300 for thereby limiting the movable range when the outer nozzle 200 moves backwards. At the mounting part 210 are preferably provided a plurality of elastic member parts 211 which are spaced apart at regular intervals for the elastic member 300 to be supported.

The content movement tube 220 serves to form a passage through which the contents inputted through the content inflow hole 120 of the inner nozzle 100 to move, and at the end of the same is provided a discharge hole 221 which is opened and closed by the blocking rod 130 in order for the inputted contents to be discharged to the outside.

The elastic member 300 is engaged surrounding the outer nozzle 200 and makes the outer nozzle move backwards, one side of the elastic member being mounted at the elastic member support part 21 of the outer nozzle 200, the other side of the same being mounted at an elastic member mounting shoulder 320 of the elastic member fixing part 400.

The elastic member 300 is contracted by the movement of the outer nozzle 200 which moves forwards by the pressure of the contents "a" at the time the button 10 is pressed, and is released when the pressed button 10 is released, for thereby providing an elastic force to the outer nozzle, by which the outer nozzle 200 can move backwards.

The elastic member fixing part 400 is engaged surrounding the outer nozzle 200 at the inner side of the inner nozzle 100 for thereby fixing the elastic member 300 and comprises an elastic member mounting shoulder 420 which is inwardly bent for the purpose of fixing the elastic member 300.

The elastic member mounting shoulder 420 serves to support one side of the elastic member 300 when the outer nozzle 200 moves forwardly, for thereby allowing the elastic member 300 to be contracted.

At the elastic member fixing part 400 is preferably provided an engaging protrusion 410 corresponding to the engaging groove 140 for the engagement to the inner nozzle 100.

The nozzle of the present invention has features in that the inner nozzle 100 and the elastic member fixing part 400 are engaged by the engaging groove 140 formed at the inner surface of the inner nozzle 400 and the engaging protrusion 410 formed at the outer surface of the elastic member fixing part 400, so the inner nozzle 100, the outer nozzle 200, the elastic member 300 and the elastic member fixing part 40 can be integrated in a module type.

The nozzle of the present invention is made in a module type which make it possible to easily engage to the engaging groove 12 formed at the discharge portion 11 of the dispenser pump button 10 with the aid of the engaging protrusion 150 formed at the outer surface of the inner nozzle 100, so the present invention can be well applied to various designs of buttons, and only the nozzle can be assembled and inspected during the manufacture process, the detect ratio can be lowered.

The operations of the nozzle of the dispenser pump button according to a preferred embodiment of the present invention will be described with reference to FIG. 5.

As shown in FIG. 5, during the operation procedures of the nozzle of the dispenser pump button according to a preferred embodiment of the present invention, when a user presses the button 10, the contents "a" starts discharging through the discharge portion 11. At this time, the contents "a" is inputted into the content movement tube 220 of the outer nozzle 200 through the content inflow hole 120.

The outer nozzle 200 moves forwards by the pressure of the contents "a" as pressure is applied to the outer nozzle 200 by the contents "a" while the contents "a" is inputted into the content movement tube 220. When the contents move forwards, the discharge hole 221, which remains closed by the blocking rod 130 of the inner nozzle 100, is opened, so the contents "a" can be discharged to the outside through the discharge hole 221.

When the user releases the pressed state of the button 10, the movement of the contents "a" stops, and the elastic member 300 returns to its initial position, thus providing electric force to the outer nozzle 200, so the outer nozzle 200 moves backwards. When the outer nozzle 200 moves backwards, the discharge hole 221 is closed by the blocking rod 130 of the inner nozzle 100 for thereby preventing the contents "a" from being discharged.

The nozzle structure of the dispenser pump button according to another embodiment of the present invention will be described with reference to FIGS. 6 to 9.

Figure 6:
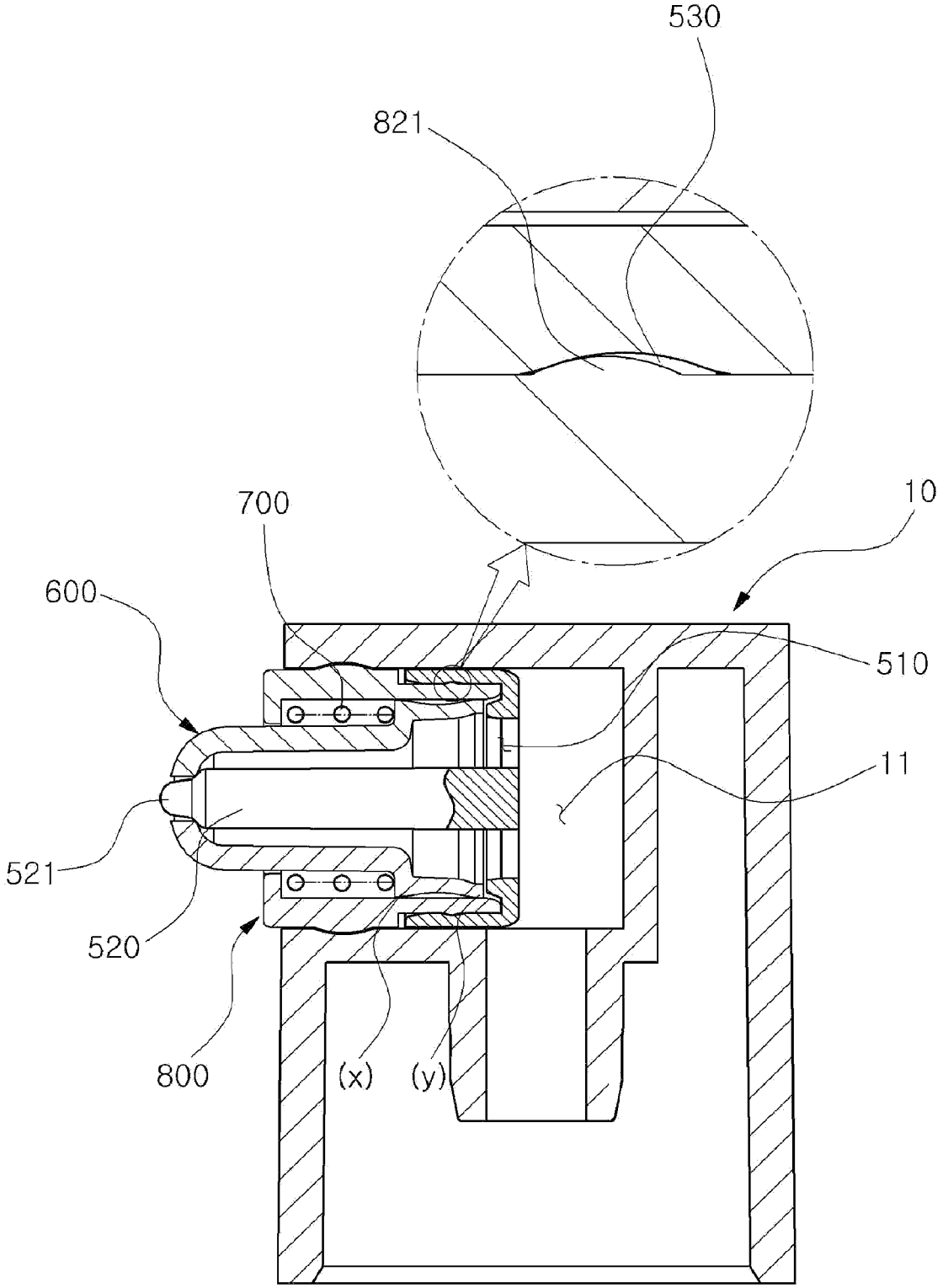
FIG. 6 is a cross sectional view illustrating a state that a nozzle of a dispenser pump button is coupled to a button according to another embodiment of the present invention.

FIG. 6 is a cross sectional view illustrating a state that a nozzle of a dispenser pump button is coupled to a button according to another embodiment of the present invention.

Figure 7:
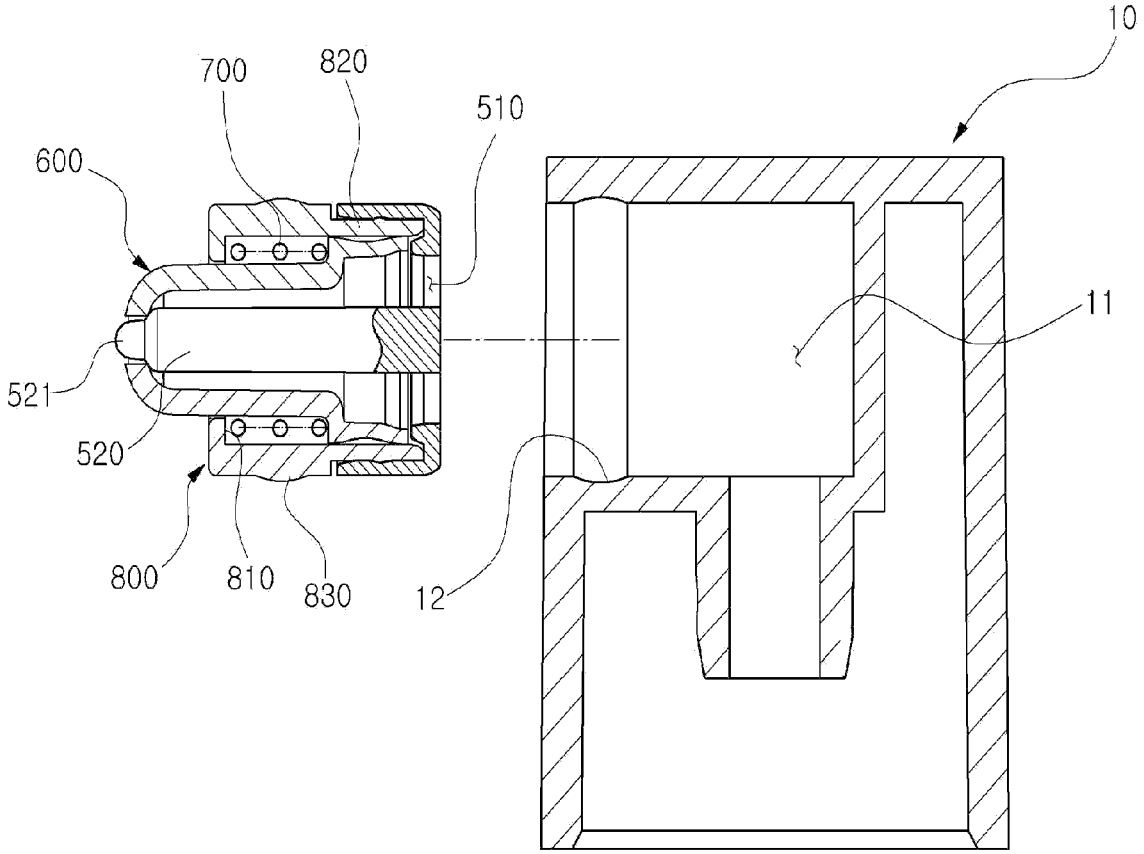
FIG. 7 is a disassembled cross sectional view illustrating a state that a nozzle of a dispenser pump button is coupled to a button according to another embodiment of the present invention.

FIG. 7 is a disassembled cross sectional view illustrating a state that a nozzle of a dispenser pump button is coupled to a button according to another embodiment of the present invention.

Figure 8:
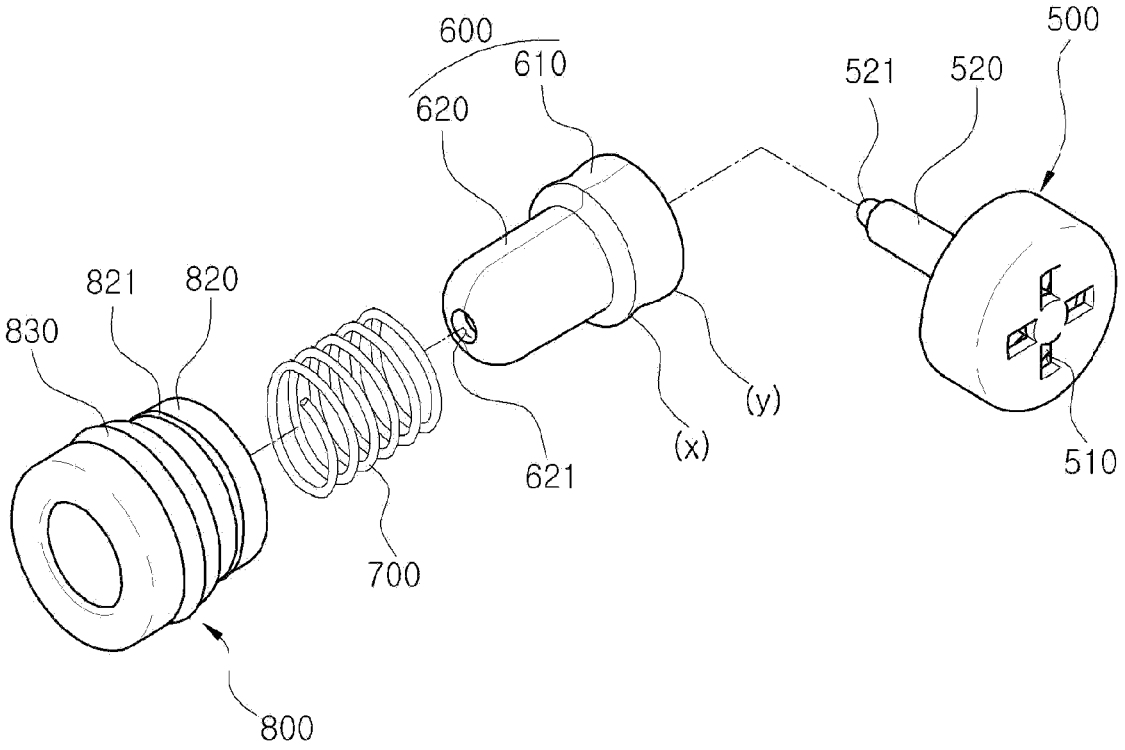
FIG. 8 is a disassembled perspective view illustrating a construction of a nozzle structure of a dispenser pump button according to another embodiment of the present invention.
Figure 9:
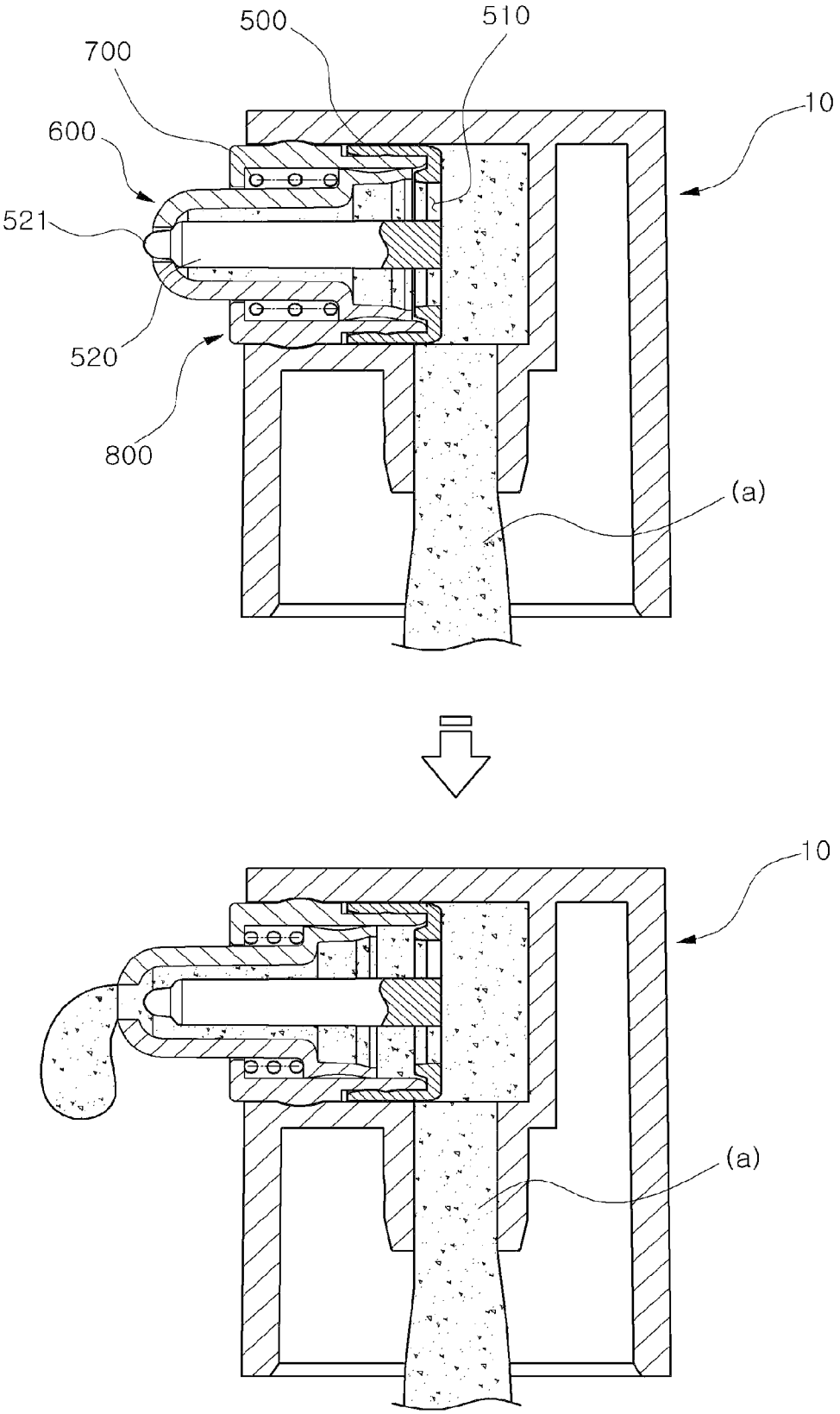
FIG. 9 is a view illustrating an operation procedure of a nozzle of a dispenser pump button according to another embodiment of the present invention.

FIG. 8 is a disassembled perspective view illustrating a construction of a nozzle structure of a dispenser pump button according to another embodiment of the present invention. FIG. 9 is a view illustrating an operation procedure of a nozzle of a dispenser pump button according to another embodiment of the present invention.

As shown in FIGS. 6 to 9, the nozzle structure of the dispenser pump button according to another embodiment of the present invention comprises an inner nozzle 500, an outer nozzle 60, an elastic member 700, and an elastic member fixing part.

The inner nozzle 500 is formed in a cylindrical shape which is coupled to the discharge portion 11 of the dispenser pump button 10 and comprises a plurality of content inflow holes 510 which are formed at the rear end at regular intervals for the sake of inflow of contents which are discharged through the discharge portion 11.

At the inner nozzle 500 is provided a blocking rod 520 which protrudes from the center of the end of the rear side to the front side for thereby opening and closing the discharge holes 621 as the outer nozzle 600 moves forwards or backwards. It is preferred that at the end portion of the blocking rod 520 is provided a protrusion 521 which protrudes to the outside of the outer nozzle 600 in order to prevent the contents from gathering at the space formed by the blocking rod 520 and the outer nozzle 600.

Since the protrusion 521 is formed at the locking rod 520, it is easy to recognize the opening and closing of the nozzle from the outside when the nozzle moves.

In the present invention, there is provided an engaging groove 530 at the inner surface of the inner nozzle 500 for securing the elastic member fixing part 800. To the engaging groove 530 is engaged the engaging protrusion 821 of the elastic member fixing part 800 for the engagement with the elastic member fixing part 800.

The outer nozzle 600 is engaged surrounding the blocking rod 520 and moves forwards or backwards by the pressure of the contents "a" or the elastic force of the elastic member 700 and comprises a mounting part 61 and a content movement tube 620.

The mounting part 610 is mounted at the inner end of the inner nozzle 500 and supports the elastic member 700. At the front side of the same is mounted the elastic member 700 for thereby pressurizing the elastic member 700 while the contents is discharged, so the elastic member 700 is contracted. When the discharge of the contents stop, the outer nozzle 600 moves backwards by the elastic force of the elastic member 700.

In the present invention, the mounting part 610 is formed in a cylindrical shape, and the front end "x" and the end portion "y" are formed in the piston structure which comes into contact with the wall surface of the inner side of the elastic member fixing part 800. With the above mentioned construction, the movements of the outer nozzle 600 can be prevented, which results in constant discharges while preventing the leak of the contents.

The content movement tube 620 extends from the center of the front side of the mounting part 610 to the forward side for thereby forming a passage through which the contents "a" inputted through the content inflow holes 510 of the inner nozzle 500 move and comprises a discharge hole 621 at the end portion, which is opened and closed by the blocking rod 520 in order for the inputted contents "a" to be discharged to the outside.

The elastic member 700 is engaged surrounding the outer nozzle 600 and moves backwardly the outer nozzle 600, one end of the elastic member 700 being mounted at the mounting part 610 of the outer nozzle 600, the other end of the same being mounted at the elastic member mounting shoulder 810 of the elastic member fixing part 800.

The elastic member 700 is contracted by the movements of the outer nozzle 600 which moves forwards by the pressure of the contents "a" when the button 10 is pressed, and the elastic member 700 is released as the pressed button 10 is released for thereby providing the elastic force to the outer nozzle 600, so the outer nozzle 600 can move backwards.

The elastic member fixing part 800 is engaged surrounding the outer nozzle 600 and the elastic member 700 for thereby fixing the elastic member 700. There is provided an elastic member mounting shoulder 810 which is bent in an inward direction in order for the elastic member 700 to be fixed.

The elastic member mounting shoulder 810 supports one side of the elastic member 700 when the outer nozzle 600 moves forwards, by which the elastic member 700 can be contracted.

At the rear side of the elastic member fixing part 800 is provided an engaging part 820 which is engaged to the inner side of the inner nozzle 500. It is preferred that at the engaging part 820 is provided an engaging protrusion 821 which corresponds to the engaging groove 530 for the sake of the engagement with the inner nozzle 500.

At the outer surface of the elastic member fixing part 800 is provided an engaging protrusion 830 engaged to the engaging groove 12. For an easier engagement to the engaging groove 12 formed at the discharge portion 11 of the dispenser pump button 10 through the engaging protrusion 830, the nozzle is made in the nozzle type, so the present invention can be well applied to various designs of buttons. Only the nozzle can be assembled and inspected during the manufacture process for thereby achieving lowered defect ratios and enhancing productivity.

In the nozzle of the present invention, the inner nozzle 500 and the elastic member fixing part 800 are engaged by the engaging groove 530 formed at the inner surface of the inner nozzle 500 and the engaging protrusion 821 formed at the outer surface of the elastic member fixing part 800, so the inner nozzle 500, the outer nozzle 600, the elastic member 700 and the elastic member fixing part 800 can be made in a module type.

The operations of the nozzle of a dispenser pump button according to another embodiment of the present invention will be described with reference to FIG. 9.

As shown in FIG. 9, the contents "a" is discharged through the discharge portion 11 when a user presses the button 100 in the operations of the nozzle of the dispenser pump button according to another embodiment of the present invention. At this time, the contents "a" is inputted into the content movement tube 620 of the outer nozzle 600 through the content inflow hole 510.

The outer nozzle 600 is pressurized by the contents "a" while the contents "a" moves into the content movement tube 620, and the outer nozzle 600 moves forwardly by the pressure of the contents "a". When the outer nozzle 600 moves forwards, the discharge hole 621 which remains closed by the blocking rod 520 of the inner nozzle 500, is opened, so the contents "a" can be discharged to the outside through the discharge hole 621.

When the user releases the pressed button 10, the movements of the contents "a" stop. At this time, the elastic member 700, which was contracted by the forward movement of the outer nozzle 600 returns to its initial state for thereby providing elastic force to the outer nozzle 600, so the outer nozzle 600 can move backwards. When the outer nozzle 60 moves backwards, the discharge hole 621 is closed by the blocking rod 520 of the inner nozzle 500, so the discharge of the contents "a" is blocked.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A nozzle structure of a dispenser pump button which is engaged to a discharge portion of a dispenser pump button for thereby discharging content to the outside, the nozzle structure comprising:

an inner nozzle which is formed in a cylindrical shape engaged to the discharge portion and has a plurality of content inflow holes formed at an end portion of a rear surface and spaced apart at regular intervals, and a blocking rod which forwardly protrudes from a center of the end portion of the rear surface;

an outer nozzle which includes:

a mounting part which is engaged surrounding the blocking rod, moves forwards and backwards, and is mounted at an end of an inner side of the inner nozzle; and a content movement tube which forwardly extends from the center of the mounting part for thereby forming a passage through which the content moves, and has a discharge hole which is opened and closed by the blocking rod;

an elastic member which is engaged surrounding the outer nozzle and moves backwardly the outer nozzle; and an elastic member fixing part which is engaged surrounding the inner nozzle at the inner side of the inner nozzle and has an elastic member mounting shoulder at which the elastic member is mounted in the inward direction, for thereby fixing one side of the elastic member, wherein at an outer surface of the inner nozzle is formed an engaging protrusion fixed at the discharge portion, and at an inner surface is formed an engaging groove to which the elastic member fixing part is engaged.

2. The structure of claim 1, wherein at the mounting part are provided a plurality of elastic member support parts which are spaced apart at regular intervals for thereby supporting the elastic member.

3. The structure of claim 1, wherein at the elastic member fixing part is formed an engaging protrusion which corresponds to the engaging groove.

4. The structure of claim 1, wherein the inner nozzle, the outer nozzle, the elastic member and the elastic member fixing part are integrated in a module type and are engaged to the engaging groove formed at the discharge portion through the engaging protrusion of the inner nozzle.

5. The structure of claim 1, wherein at the inner surface of the inner nozzle is formed an engaging groove at which the elastic member fixing part is fixed, and at the elastic member fixing part is formed an engaging protrusion which is engaged to the engaging groove.

6. The structure of claim 1, wherein at the end of the blocking rod is formed a protrusion which protruded towards the outside of the outer nozzle.

* * * * *